US007286778B2

(12) United States Patent
Burry et al.

(10) Patent No.: US 7,286,778 B2
(45) Date of Patent: Oct. 23, 2007

(54) FEED FORWARD MITIGATION OF DEVELOPMENT TRANSIENTS

(75) Inventors: Aaron M. Burry, Henrietta, NY (US); Daniel M. Bray, Rochester, NY (US); Paul C. Julien, Webster, NY (US)

(73) Assignee: Xerox Corporation, Stamford, CT (US)

( * ) Notice: Subject to any disclaimer, the term of this patent is extended or adjusted under 35 U.S.C. 154(b) by 83 days.

(21) Appl. No.: 11/172,301

(22) Filed: Jun. 30, 2005

(65) Prior Publication Data

US 2007/0003303 A1 Jan. 4, 2007

(51) Int. Cl.
*G03G 15/08* (2006.01)

(52) U.S. Cl. ..... 399/53

(58) Field of Classification Search ..... 399/49, 399/50, 51, 53, 55, 60, 267
See application file for complete search history.

(56) References Cited

U.S. PATENT DOCUMENTS 5,887,223 A * 3/1999 Sakai et al. ..... 399/60
6,768,878 B2 * 7/2004 Komatsu et al. ..... 399/49
6,947,681 B2 * 9/2005 Ogata ..... 399/60 X

OTHER PUBLICATIONS

U.S. Appl. No. 10/998,098 entitled "Method of Detecting Pages Subject to Reload Defect," by R. Victor Klaussen filed Nov. 24, 2004.

U.S. Appl. No. 11/090,727 entitled "Method and System for Reducing Toner Abuse in Development Systems of Eelctrophotographic Systems," by Paul Julien et al.

* cited by examiner

*Primary Examiner*—Sandra L. Brase
(74) *Attorney, Agent, or Firm*—Lloyd F. Bean, II

(57) ABSTRACT

A development system for an electrophotographic system including: a magnetic brush roll speed selector for selecting a rotational speed for a magnetic brush roll in a development system of the electrophotographic system; and a controller, responsive to the rotational speed, for adjusting xerographic actuators to maintain DMA within a predefined range.

16 Claims, 8 Drawing Sheets

FEED FORWARD MITIGATION OF DEVELOPMENT TRANSIENTS

The present invention relates generally to electrophotographic printing machines and more particularly to development systems in electrophotographic printing machines.

BACKGROUND

Generally, the process of electrophotographic printing includes charging a photoconductive member to a substantially uniform potential to sensitize its surface. The charged portion of the photoconductive surface is exposed to a light image from a scanning laser beam or an LED source that corresponds to an original document being reproduced. The effect of the light on the charged surface produces an electrostatic latent image on the photoconductive surface. After the electrostatic latent image is recorded on the photoconductive surface, the latent image is developed. Two-component and single-component developer materials are commonly used for development. A typical two-component developer comprises a mixture of magnetic carrier granules and toner particles. A single-component developer material is typically comprised of toner particles without carrier particles. Toner particles are attracted to the latent image, forming a toner powder image on the latent image of the photoconductive surface. The toner powder image is subsequently transferred to a copy sheet. Finally, the toner powder image is heated to permanently fuse it to the copy sheet to form the hard copy image.

The approach utilized for multicolor electrophotographic printing is substantially identical to the process described above. However, rather than forming a single latent image on the photoconductive surface in order to reproduce an original document, as in the case of black and white printing, multiple latent images corresponding to color separations are sequentially recorded on the photoconductive surface. Each single color electrostatic latent image is developed with toner of a color corresponding thereto and the process is repeated for differently colored images with the respective toner of corresponding color. Thereafter, each single color toner image can be transferred to the copy sheet in superimposed registration with the prior toner image, creating a multi-layered toner image on the copy sheet. Finally, this multi-layered toner image is permanently affixed to the copy sheet in substantially conventional manner to form a finished copy.

With the increase in use and flexibility of printing machines, especially color printing machines which print with two or more different colored toners, it has become increasingly important to monitor the toner development process so that increased print quality, stability and control requirements can be met and maintained. For example, it is very important for each component color of a multi-color image to be stably formed at the correct toner density because any deviation from the correct toner density may be visible in the final composite image. Additionally, deviations from desired toner densities may also cause visible defects in mono-color images, particularly when such images are half-tone images. Therefore, many methods have been developed to monitor the toner development process to detect present or prevent future image quality problems.

For example, it is known to monitor the developed mass per unit area (DMA) for a toner development process by using densitometers such as infrared densitometers (IRDs) to measure the mass of a toner process control patch formed on an imaging member. IRDs measure total developed mass (i.e., on the imaging member), which is a function of developablitiy and electrostatics. Electrostatic voltages are measured using a sensor such as an ElectroStatic Voltmeter (ESV). Developability is the rate at which development (toner mass/area) takes place. The rate is usually a function of the toner concentration in the developer housing. Toner concentration (TC) is measured by directly measuring the percentage of toner in the developer housing (which, as is well known, contains toner and carrier particles).

As indicated above, the development process is typically monitored (and thereby controlled) by measuring the mass of a toner process control patch and by measuring toner concentration (TC) in the developer housing. However, the relationship between TC and developability is affected by other variables, such as ambient temperature, humidity and the age of the toner. For example, a seven-percent TC results in different developabilities depending on the variables listed above.

One common type of development system uses one or more donor rolls to convey toner to the latent image on the photoconductive member. A donor roll is loaded with toner either from a two-component mixture of toner and carrier particles or from a single-component supply of toner. The toner is charged either from its triboelectric interaction with carrier beads or from suitable charging devices, such as frictional or biased blades or from other charging devices. As the donor roll rotates it carries toner from the loading zone to the latent image on the photoconductive member. There, suitable electric fields can be applied with a combination of DC and AC biases to the donor roll to cause the toner to develop to the latent image. Additional electrodes, such as those used in the Hybrid Scavengeless Development (HSD) technology may also be employed to excite the toner into a cloud from which it can be harvested more easily by the latent image. The process of conveying toner to the latent image on the photoreceptor is known as development.

A problem with donor roll developer systems is a defect known as ghosting or reload which appears as a lightened ghost image of a previously developed image in a halftone or solid on a print. The reload defect occurs when insufficient toner has been loaded onto the donor roll within one revolution of the donor roll after an image has been printed. In this situation, there will be a localized region of the donor roll that is not fully loaded with toner (it has been depleted of toner mass by the previous image). The donor roll thus retains the memory of the previous image, and a ghost of the previous image shows up if another image is printed at that time.

The susceptibility of the development system to a reload defect is dependent upon the image content of the print job (how much toner was removed from the donor roll by the image areas of the previous image) as well as the rate at which toner is reloaded onto the donor rolls (the maximum rate at which toner can be re-supplied to the donors). One way of improving the ability of the toner supply to provide an adequate amount of toner to reduce or prevent ghost images is to increase the peripheral speed of the magnetic brush or roll that transfers toner from the supply reservoir to the donor roll. However, as the relative difference in the speeds of the magnetic brush and donor rolls increases so do the collisions of the carrier or toner granules. The toner particles also impinge on the blade mounted proximate to the magnetic brush to regulate or trim the height of the magnetic brush so that a controlled amount of toner is transported to the developer roll. The collisions of the toner with the carrier and the trim blade tend to smooth the surface of the toner particles and cause the particles to exhibit increased adhesion. In general, the surface of the carrier particles can be affected by these collisions (with other carriers, trim bars, etc) as well. This general process is sometimes referred to as material abuse. The increased adhesion of the toner particles that have experienced a great deal of abuse causes less toner to be transferred to the photoreceptor to develop the latent image for a given development voltage. Thus, there is a tradeoff between increased speed of the magnetic brush to improve reload performance and the rate of material abuse. In most development systems, the tradeoff between increased toner supply and material abuse is made at design time. Typically the speed of the magnetic brush or roll is selected such that a solid patch can be developed within one donor revolution of another solid patch with minimal reload effects being observable in the developed mass image.

Material abuse is a problem for many development systems when printing low area cover (LAC) jobs. For LAC print jobs, there is little toner throughput and so the average age of the material in the developer sump can increase substantially. One potential problem as the age of the material in the sump increases is that the level of abuse that a given toner or carrier particle has experienced can actually become quite high. When this occurs, the developability of the toner particles generally tends to decrease, which then leads to a degradation in the performance of the development subsystem. In some circumstances, increased toner age and the associated increases in material abuse can also lead to problems in the transfer subsystem as well. Eventually these effects can lead to substantial print quality (PQ) problems that may require costly mitigation strategies.

One method for controlling the rate of material abuse in the developer housing is to maintain some constant level of abuse of the material independent of the image content that is being printed. This can be accomplished by adjusting how much energy is input to the developer housing based on the current image content of the customer's print job.

In another method, as disclosed in U.S. application Ser. No. 11/090,727 and is hereby incorporated by reference, employs the method of adjusting the speed of the magnetic roll on-the-fly based on image content to reduce material abuse. As discussed previously, reducing the speed of the magnetic roll can help to reduce the amount of material abuse that occurs within the developer housing. However, a major difficulty with reducing the speed of the magnetic roll is the occurrence of the reload defect. To minimize the occurrence of this defect, a reload sensitivity detection algorithm determines which pages within a customer's job are candidates for speed reduction without the possibility of inducing reload defects. Using this feed-forward information, the controller can then appropriately adjust the speed of the magnetic roll while attempting to minimize the chance for inducing reload defects in the output prints. Such an approach has enabled a performance improvement in terms of development stability and transfer performance over long LAC jobs. However, Applicants have found that there are significant undesirable Developed Mass per unit Area (DMA) shifts in the development performance when the speed of the magnetic roll is changed which then leads to undesirable color shifts and thus to poor output image quality.

Consequently, there is a need to provide a method and apparatus for maintaining stable DMA performance from the development subsystem independent of the speed profile applied to the magnetic brush or roll.

SUMMARY

There is provided a development system for an electrophotographic system including a magnetic roll speed selector for selecting a rotational speed for a magnetic roll in a development system of the electrophotographic system; and a controller, responsive to said rotational speed, for adjusting xerographic actuators to maintain DMA within a predefined range despite variations in the rotational speed of the magnetic roll.

The above described features and advantages, as well as others, will become more readily apparent to those of ordinary skill in the art by reference to the following detailed description and accompanying drawings.

BRIEF DESCRIPTION OF THE DRAWINGS

By way of example, an embodiment of the invention will be described with reference to the accompanying drawings, in which:

[FIG. 7*a* illustrates the results for a constant mag roll speed under standard process controls. This is meant to be used as a comparison with the noise level of the final results (where the speed of the mag roll is being changed). FIG. 7*b* illustrates the case with standard process controls where the speed of the mag roll is being varied between two speed levels throughout the print job. FIG. 7*c* illustrates the results for the present algorithm under similar conditions].

DETAILED DESCRIPTION

Figure 1:
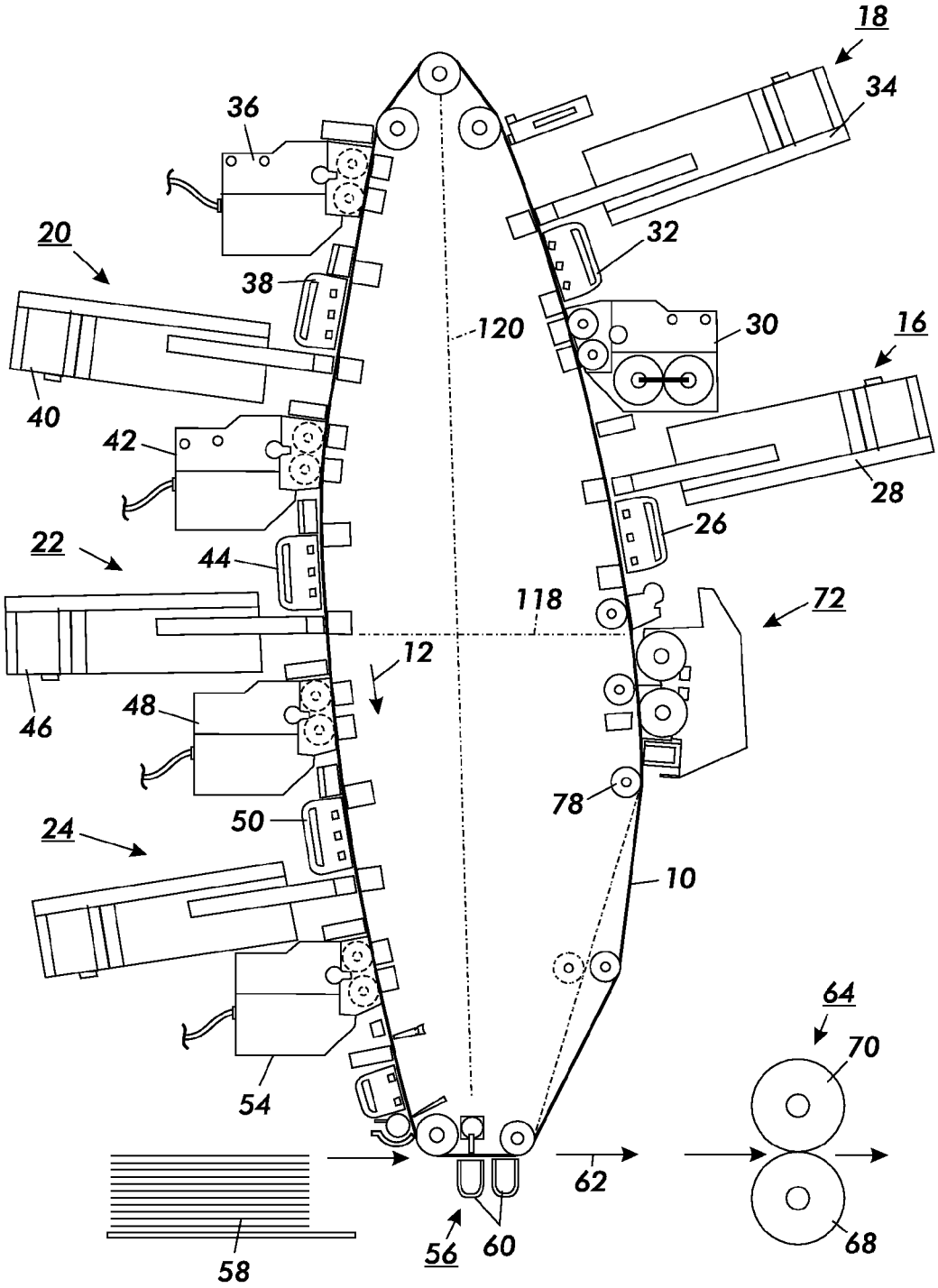
FIG. 1 is a schematic elevational view depicting an illustrative electrophotographic printing machine incorporating the development apparatus of the present invention therein.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate identical elements.

Referring now to FIG. 1, there is shown a single pass multi-color printing machine. This printing machine employs a photoconductive belt 10, supported by a plurality of rollers or bars, 12. Photoconductive belt 10 is arranged in a vertical orientation. Photoconductive belt 10 advances in the direction of arrow 14 to move successive portions of the external surface of photoconductive belt 10 sequentially beneath the various processing stations disposed about the path of movement thereof. The photoconductive belt has a major axis 120 and a minor axis 118. The major and minor axes are perpendicular to one another. Photoconductive belt 10 is elliptically shaped. The major axis 120 is substantially parallel to the gravitational vector and arranged in a substantially vertical orientation. The minor axis 118 is substantially perpendicular to the gravitational vector and arranged in a substantially horizontal direction. The printing machine architecture includes five image recording stations indicated generally by the reference numerals 16, 18, 20, 22, and 24, respectively. Initially, photoconductive belt 10 passes through image recording station 16. Image recording station 16 includes a charging device and an exposure device. The charging device includes a corona generator 26 that charges the exterior surface of photoconductive belt 10 to a relatively high, substantially uniform potential. After the exterior surface of photoconductive belt 10 is charged, the charged portion thereof advances to the exposure device. The exposure device includes a raster output scanner (ROS) 28, which illuminates the charged portion of the exterior surface of photoconductive belt 10 to record a first electrostatic latent image thereon. Alternatively, a light emitting diode (LED) may be used.

This first electrostatic latent image is developed by developer unit 30. Developer unit 30 deposits toner particles of a selected color on the first electrostatic latent image. After the highlight toner image has been developed on the exterior surface of photoconductive belt 10, belt 10 continues to advance in the direction of arrow 14 to image recording station 18.

Image recording station 18 includes a recharging device and an exposure device. The charging device includes a corona generator 32 which recharges the exterior surface of photoconductive belt 10 to a relatively high, substantially uniform potential. The exposure device includes a ROS 34 which illuminates the charged portion of the exterior surface of photoconductive belt 10 selectively to record a second electrostatic latent image thereon. This second electrostatic latent image corresponds to the regions to be developed with magenta toner particles. This second electrostatic latent image is now advanced to the next successive developer unit 36.

Developer unit 36 deposits magenta toner particles on the electrostatic latent image. In this way, a magenta toner powder image is formed on the exterior surface of photoconductive belt 10. After the magenta toner powder image has been developed on the exterior surface of photoconductive belt 10, photoconductive belt 10 continues to advance in the direction of arrow 14 to image recording station 20.

Image recording station 20 includes a charging device and an exposure device. The charging device includes corona generator 38, which recharges the photoconductive surface to a relatively high, substantially uniform potential. The exposure device includes ROS 40 which illuminates the charged portion of the exterior surface of photoconductive belt 10 to selectively dissipate the charge thereon to record a third electrostatic latent image corresponding to the regions to be developed with yellow toner particles. This third electrostatic latent image is now advanced to the next successive developer unit 42.

Developer unit 42 deposits yellow toner particles on the exterior surface of photoconductive belt 10 to form a yellow toner powder image thereon. After the third electrostatic latent image has been developed with yellow toner, photoconductive belt 10 advances in the direction of arrow 14 to the next image recording station 22.

Image recording station 22 includes a charging device and an exposure device. The charging device includes a corona generator 44, which charges the exterior surface of photoconductive belt 10 to a relatively high, substantially uniform potential. The exposure device includes ROS 46, which illuminates the charged portion of the exterior surface of photoconductive belt 10 to selectively dissipate the charge on the exterior surface of photoconductive belt 10 to record a fourth electrostatic latent image for development with cyan toner particles. After the fourth electrostatic latent image is recorded on the exterior surface of photoconductive belt 10, photoconductive belt 10 advances this electrostatic latent image to the cyan developer unit 48.

Cyan developer unit 48 deposits cyan toner particles on the fourth electrostatic latent image. These toner particles may be partially in superimposed registration with the previously formed yellow and magenta powder images. After the cyan toner powder image is formed on the exterior surface of photoconductive belt 10, photoconductive belt 10 advances to the next image recording station 24.

Image recording station 24 includes a charging device and an exposure device. The charging device includes corona generator 50 which charges the exterior surface of photoconductive belt 10 to a relatively high, substantially uniform potential. The exposure device includes ROS 52, which illuminates the charged portion of the exterior surface of photoconductive belt 10 to selectively discharge those portions of the charged exterior surface of photoconductive belt 10, which are to be developed with black toner particles. The fifth electrostatic latent image to be developed with black toner particles is advanced to black developer unit 54.

At black developer unit 54, black toner particles are deposited on the exterior surface of photoconductive belt 10. These black toner particles form a black toner powder image which may be partially or totally in superimposed registration with the previously formed yellow, magenta, and cyan toner powder images. In this way, a multi-color toner powder image is formed on the exterior surface of photoconductive belt 10. Thereafter, photoconductive belt 10 advances the multi-color toner powder image to a transfer station, indicated generally by the reference numeral 56.

At transfer station 56, a receiving medium, i.e., paper, is advanced from stack 58 by sheet feeders and guided to transfer station 56. At transfer station 56, a corona generating device 60 sprays ions onto the backside of the paper. This attracts the developed multi-color toner image from the exterior surface of photoconductive belt 10 to the sheet of paper. Stripping assist roller contacts the interior surface of photoconductive belt 10 and provides a sufficiently sharp bend thereat so that the beam strength of the advancing paper strips from photoconductive belt 10. A vacuum transport moves the sheet of paper in the direction of arrow 62 to fusing station 64.

Fusing station 64 includes a heated fuser roller 70 and a back-up roller 68. The back-up roller 68 is resiliently urged into engagement with the fuser roller 70 to form a nip through which the sheet of paper passes. In the fusing operation, the toner particles coalesce with one another and bond to the sheet in image configuration, forming a multi-color image thereon. After fusing, the finished sheet is discharged to a finishing station where the sheets are compiled and formed into sets which may be bound to one another. These sets are then advanced to a catch tray for subsequent removal therefrom by the printing machine operator.

One skilled in the art will appreciate that while the multi-color developed image has been disclosed as being transferred to paper, it may be transferred to an intermediate member, such as a belt or drum, and then subsequently transferred and fused to the paper. Furthermore, while toner powder images and toner particles have been disclosed herein, one skilled in the art will appreciate that a liquid developer material employing toner particles in a liquid carrier may also be used.

Invariably, after the multi-color toner powder image has been transferred to the sheet of paper, residual toner particles remain adhering to the exterior surface of photoconductive belt 10. The photoconductive belt 10 moves over isolation roller 78 which isolates the cleaning operation at cleaning station 72. At cleaning station 72, the residual toner particles are removed from photoconductive belt 10. Photoconductive belt 10 then moves under spots blade to also remove toner particles therefrom.

Figure 2:
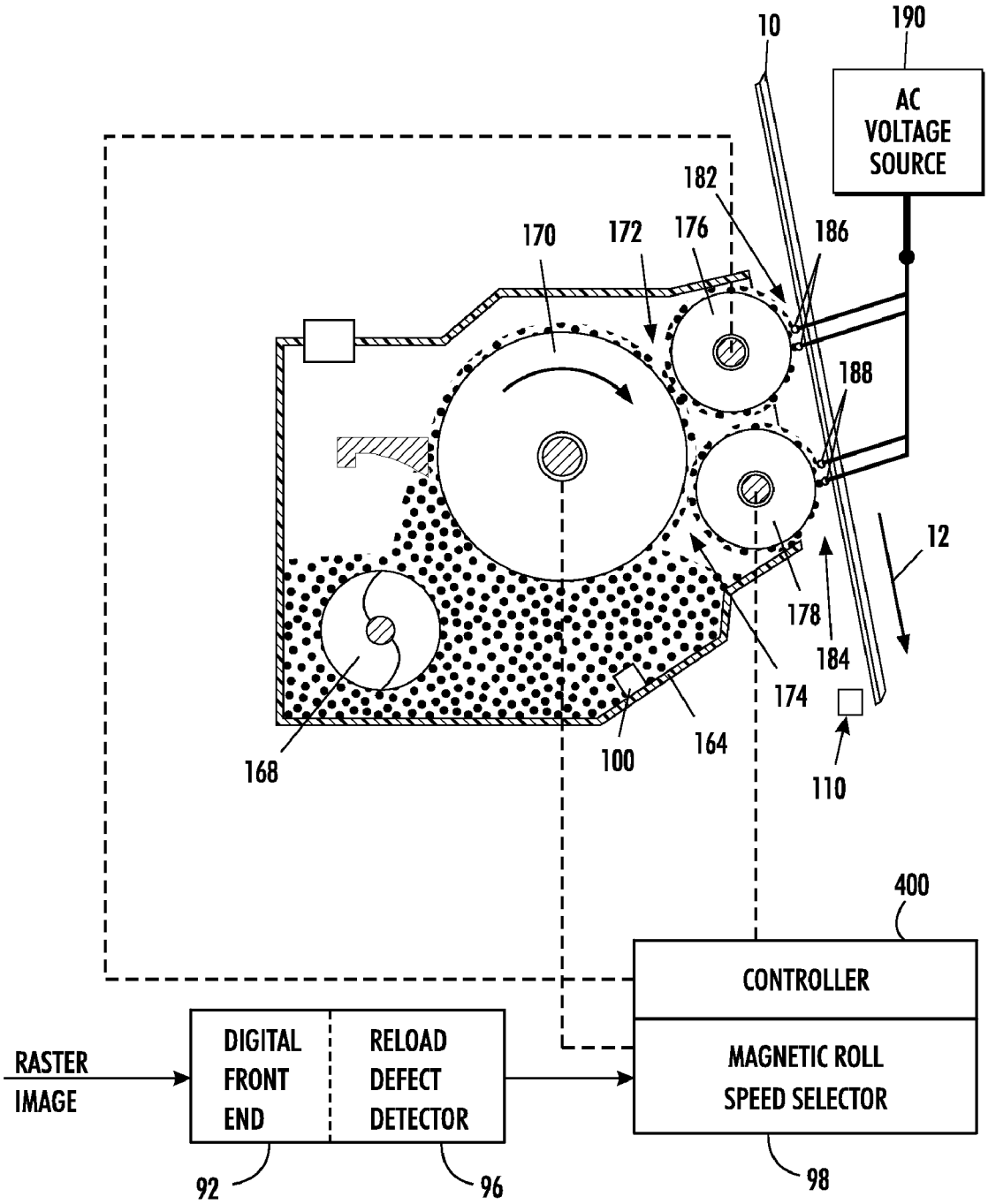
FIG. 2 is a schematic elevational view showing the development apparatus of the FIG. 1 printing machine in greater detail.

Referring now to FIG. 2, the details of the development apparatus are shown. The apparatus comprises a reservoir 164 containing developer material. The developer material is of the two component type, that is it comprises carrier granules and toner particles. The reservoir includes augers, indicated at 168, which are rotatably-mounted in the reservoir chamber. The augers 168 serve to transport and to agitate the material within the reservoir and encourage the toner particles to charge tribo-electrically and adhere to the carrier granules. A magnetic brush roll 170 transports developer material from the reservoir to the loading nips 172, 174 of two donor rolls 176, 178. Magnetic brush rolls are well known, so the construction of roll 170 need not be described in great detail. Briefly the roll comprises a rotatable tubular housing within which is located a stationary magnetic cylinder having a plurality of magnetic poles impressed around its surface. The carrier granules of the developer material are magnetic and, as the tubular housing of the roll 170 rotates, the granules (with toner particles adhering triboelectrically thereto) are attracted to the roll 170 and are conveyed to the donor roll loading nips 172, 174. A metering blade removes excess developer material from the magnetic brush roll and ensures an even depth of coverage with developer material before arrival at the first donor roll loading nip 172. At each of the donor roll loading nips 172, 174, toner particles are transferred from the magnetic brush roll 170 to the respective donor roll 176, 178.

Each donor roll transports the toner to a respective development zone 182, 184 through which the photoconductive belt 10 passes. Transfer of toner from the magnetic brush roll 170 to the donor rolls 176, 178 can be encouraged by, for example, the application of a suitable D.C. (and/or A.C.) electrical bias to the magnetic brush and/or donor rolls. The D.C. bias (for example, approximately 70 V applied to the magnetic roll) establishes an electrostatic field between the donor roll and magnetic brush rolls, which causes toner particles to be attracted to the donor roll from the carrier granules on the magnetic roll.

The carrier granules and any toner particles that remain on the magnetic brush roll 170 are returned to the reservoir 164 as the magnetic brush continues to rotate. The relative amounts of toner transferred from the magnetic brush roll 170 to the donor rolls 176, 178 can be adjusted, for example by: applying different bias voltages to the donor rolls; adjusting the magnetic brush to donor roll spacing; adjusting the strength and shape of the magnetic field at the loading nips and/or adjusting the speeds of the donor rolls.

At each of the development zones 182, 184, toner is transferred from the respective donor rolls 176, 178 to the latent image on the belt 10 to form a toner powder image on the latter. Various methods of achieving an adequate transfer of toner from a donor roll to a photoconductive surface are known and any of those may be employed at the development zones 182, 184.

In FIG. 2, each of the development zones 182, 184 is shown as having the form i.e. electrode wires are disposed in the space between donor rolls 176, 178 and photoconductive belt 10. FIG. 2 shows, for each donor roll 176, 178, a respective pair of electrode wires 186, 188 extending in a direction substantially parallel to the longitudinal axis of the donor roll. The electrode wires are made from thin (i.e. 50 to 100 micron diameter) stainless steel wires which are closely spaced from the respective donor roll. The wires are self-spaced from the donor rolls by the thickness of the toner on the donor rolls. The distance between each wire and the respective donor roll is within the range from about 5 micron to about 20 micron (typically about 10 micron) or the thickness of the toner layer on the donor roll. An alternating electrical bias is applied to the electrode wires by an AC voltage source 190.

The applied AC establishes an alternating electrostatic field between each pair of wires and the respective donor roll, which is effective in detaching toner from the surface of the donor roll and forming a toner cloud about the wires, the height of the cloud being such as not to be substantially in contact with the belt 10. The magnitude of the AC voltage in the order of 200 to 500 volts peak at frequency ranging from about 8 kHz to about 16 kHz. A DC bias supply (not shown) applied to donor rolls 176, 178 establishes electrostatic fields between the photoconductive belt 10 and donor rolls for attracting the detached toner particles from the clouds surrounding the wires to the latent image recorded on the photoconductive surface of the belt.

As successive electrostatic latent images are developed, the toner particles within the developer material are depleted. A toner dispenser (not shown) stores a supply of toner particles. The toner dispenser is in communication with reservoir 164 and, as the concentration of toner particles in the developer material is decreased, fresh toner particles are furnished to the developer material in the reservoir. The auger 168 in the reservoir chamber mixes the fresh toner particles with the remaining developer material so that the resultant developer material therein is substantially uniform with the concentration of toner particles being optimized. In this way, a substantially constant amount of toner particles is in the reservoir with the toner particles having a constant charge.

The two-component developer used in the apparatus of FIG. 2 may be of any suitable type. However, the use of an electrically conductive developer is preferred because it eliminates the possibility of charge build-up within the developer material on the magnetic brush roll which, in turn, could adversely affect development at the second donor roll. By way of example, the carrier granules of the developer material may include a ferromagnetic core having a thin layer of magnetite overcoated with a non-continuous layer of resinous material. The toner particles may be made from a resinous material, such as a vinyl polymer, mixed with a coloring material, such as chromogen black. The developer material may comprise from about 95% to about 99% by weight of carrier and from 5% to about 1% by weight of toner.

The carrier granules and any toner particles that remain on the magnetic brush roll 170 are returned to the reservoir 164 as the magnetic brush continues to rotate. The relative amounts of toner transferred from the magnetic brush roll 170 to the donor rolls 176, 178 can be adjusted, for example by: applying different bias voltages to the donor rolls; adjusting the magnetic brush to donor roll spacing; adjusting the strength and shape of the magnetic field at the loading nips and/or adjusting the speeds of the donor rolls.

At each of the development zones 182, 184, toner is transferred from the respective donor rolls 176, 178 to the latent image on the belt 10 to form a toner powder image on the latter. Various methods of achieving an adequate transfer of toner from a donor roll to a photoconductive surface are known and any of those may be employed at the development zones 182, 184. The developer unit includes a toner concentration sensor 100, such as a packer toner concentration sensor, for sensing toner concentration (TC). [The present invention doesn't make use of the TC sensor] In accordance with aspects of the present disclosure, the developer unit also includes a mass sensor 110, such as an enhanced toner area coverage (ETAC) sensor. This sensor measures developed mass per unit area and can be utilized as feedback to adjust the feed forward controller as part of the present disclosure.

In order to explain aspects of the present disclosure, it is first necessary to acquaint the reader with important information regarding Ghosting. Ghosting, also known as reload, is a defect inherent to donor roll development technologies. It occurs both for single-component as well as hybrid systems, in which the toner layer on the donor roll is loaded by a magnetic brush. Generally, when an image is developed to a photoreceptor a negative of the image is left on the donor roll. This negative of the image, or ghost, persists to some extent even after it passes through the donor loading nip. Depending on the exact conditions of the loading nip, the ghost can persist as a mass difference, a tribo difference, a toner size difference, or a combination of these to give a toner layer voltage difference. Even subtle differences in these quantities can lead to differential development as the reloaded ghost image develops to the photoreceptor during its next rotation. A stress image pattern to quantify ghosting would be a solid area followed by a mid-density fine halftone at the position in the print corresponding to one donor roll revolution after the solid. Attempts to minimize the ghosting defect have focused on improving the donor loading so that the differences in toner layer properties between a ghost image and its surroundings are minimized after the reload step. While successful to some degree, ghosting is a problem that still limits system latitude in all donor roll development technologies.

Donor roll development systems produce an image ghost at a position on the print corresponding to one donor roll revolution after the image. The ghost image for a donor roll occurs at a position G1 after the original image on the photoreceptor. The position may be described as:

$$G1=U_{pr}*2\pi r/U_d$$

where $U_{pr}$ is the speed of the photoreceptor, r is the radius of the donor roll, and $U_{d1}$ is the surface speed of the donor roll. This relation holds for either direction of rotation of the donor roll. The image content at this position may be evaluated to determine whether it has the potential to generate a reload defect. Methods for determining the potential to generate a reload defect are set forth in a co-pending patent application that is commonly owned by the assignee of this application, U.S. Ser. No. 10/998,098, now U.S. Publication No. 20060109487, entitled "METHOD OF DETECTING PAGES SUBJECT TO RELOAD DEFECT," the entire disclosure of which is hereby expressly incorporated in its entirety in this application by reference.

A reload defect detector may scan a reduced resolution image looking for locations where there is more than the minimum source level. A source area is a location on an image where toner may be removed from a donor in an amount sufficient to cause reload defect at a later point in the image. The minimum source level is the minimum amount of toner coverage that may later cause reload defect. A destination area is also evaluated. The destination area is a location at the appropriate number of scan lines after the source and, typically, corresponds to a location that is one donor revolution from the source position. The destination area is evaluated to determine whether the toner coverage at the destination area is greater than a minimum destination level. That is, the reload detector evaluates source areas and destination areas that are approximately one donor roll distance from one another to determine whether the source area "robs" sufficient toner from the donor roll to produce a ghost of the source area at the destination area. Locations meeting that criterion are then checked for high spatial frequency content (for example, by using a simple edge detection filter), and, if they lack high spatial frequencies, they may then be checked for neighbors that have also passed these tests. The neighboring pixels may be checked to see whether they tentatively cause reload defects by building a Boolean map of the test results, where a location in the map is true if the corresponding pixel has been evaluated to have reload defect potential. The logical AND of all the locations in a neighborhood may be used to combine the neighboring results. Other implementations are possible. Where enough neighbors are found, the pixel is considered to have reload potential, and that color separation component of the image is flagged as having reload potential.

A reload defect detector may use a reduced resolution image, where the resolution is selected so that the minimum feature width corresponds to approximately three pixels wide. Alternatively, the image evaluated may be a higher resolution image, including a full resolution image, in which case the neighborhoods used in the various tests would be correspondingly larger. A reload defect detector may also evaluate only a portion of an image. For example, if a document is printing on a template, only the variable data portion need be examined since the template portion of the document is the same for each page. In this scenario, a reduced amount of data would be retained for the template portion to indicate those portions of the template that may cause reload in the variable portion, and which portions might exhibit reload caused by the variable portion of the document. At a later time (i.e., page assembly time), the variable portion would be checked to determine whether it would produce reload in the previously examined template portion, or exhibit reload due to the data found in the previously examined template portion.

Many commercially available digital front end (DFE) processors for electrophotographic machines have the ability to generate low resolution images that may be used for reload defect evaluation. In particular, one-eighth resolution "thumbnail" images of the pages as they are raster scanned are produced for other applications and may be used for reload defect evaluation. A reload artifact detector may read those images and generate signals to transmit to the control software. In one embodiment, the DFE software may include the operation of computing a thumbnail image at some convenient size, for example one-eighth the original resolution, and then the DFE software or an additional software component reads the thumbnail image and evaluates the image for reload defect.

The digital front end processor (DFE) 92 of the electrophotographic machine shown in FIG. 2 includes a reload defect detector 96 for generating a signal corresponding to a potential for reload defect detected in an image to be developed by an electrophotographic system. The DFE 92 receives a reduced or full size raster scanned image for evaluation. The DFE 92 may include one or more software modules to implement the reload defect detector 96. Alternatively, the reload defect detector 96 may be included in the software library for the development controller 400 or it may be implemented in its own application specific integrated circuit (ASIC) as a stand alone component interposed between the magnetic roll speed selector 98 and the DFE 92. The reload defect detector 96 operates to compare the size and coverage of source and destination areas approximately one donor roll distance apart to determine whether a reload defect is possible. In an electrophotographic system having two donor rolls, the reload defect detector evaluates source and destination areas of the scan image at a donor roll distance corresponding to each donor roll. The donor roll distances vary from one another because of variations in the rotational speeds of the two donor rolls. The reload defect detector 96 generates a signal to the magnetic roll speed selector 98 that indicates whether or not a reload defect is likely to occur on a page corresponding to a latent image to be developed by the development system. In a two donor roll system, the reload defect detector 96 generates a signal indicating a reload defect is likely in response to either donor roll evaluation indicating a reload defect is likely. Alternatively, the signal may be one that indicates a probability that a reload defect will occur. The probability may reflect the likelihood that a reload defect, though produced by the electrophotographic system, may not be visible to a user. For example, if the image causing a reload defect is rendered with a light tint or has little spatial extent, the amount of toner involved may be so small that the defect is not visible.

The magnetic roll speed selector 98 selects a rotational speed for a magnetic roll in the improved development system. The magnetic roll speed selector 98 may be implemented with one or more software modules in the controller 400. Alternatively, the magnetic roll speed selector may be comprised of software components or hardware components of the DFE 92 or it may be implemented in its own application specific integrated circuit (ASIC) as a stand alone component interposed between the reload defect detector 96 and the DFE 92. In response to the signal from the reload defect detector 96, the magnetic speed selector adjusts the speed signal to the magnetic brush roll 170. In the embodiment in which the potential reload defect signal indicates a probability, the rotational speed may be selected from a range of possible magnetic roll speeds.

The signal generated by the reload defect detector 96 may take a variety of forms. For example, the reload defect detector may generate an analog signal indicative of a reload defect potential in the image to be developed by the electrophotographic system. The peak to peak value of the signal or its frequency may indicate the potential that a reload defect will occur from developing an image. Alternatively, the reload defect detector may generate a digital signal that indicates a reload defect potential in the image to be developed by the electrophotographic system. The digital signal may be a binary signal or a digital value that is indicative of a probability for the detected reload defect. The binary signal indicates whether a reload defect is likely to occur or not. The digital value is a multi-bit data word that may be used to quantify the potential for the detected reload defect. The greater the digital value, the higher the speed at which the magnetic roll is driven.

The magnetic roll speed selector 98 is coupled to the reload defect detector 96 and generates a signal in response to the reload defect potential signal received from the reload defect detector. When the reload defect potential signal is an analog signal, the magnetic roll speed selector 98 compares the analog signal to a reference threshold voltage or frequency to determine the potential for a reload defect. When the reload defect potential signal is a digital signal, the speed selector determines the state of the signal, if it is a binary signal, or the value of the signal, if it is a digital value.

The magnetic roll speed selector 98 may generate a current signal corresponding to a rotational speed magnitude. This current signal may be provided to the motor drive for the magnetic brush roll 170. The greater the magnitude of the current, the higher the speed at which the magnetic roll is driven. The magnetic roll speed selector may alternatively generate an analog signal, the voltage of which corresponds to a rotational speed magnitude. That is, the peak to peak voltage for the generated signal may be a control signal for the magnetic roll driver.

The magnetic roll speed selector may generate a digital signal corresponding to a rotational speed magnitude for the magnetic roll. The digital signal may be a binary signal or a digital value. When the digital signal is a binary signal, the state of the signal determines whether the magnetic roll is driven at a high speed or a low speed. In one embodiment, the low speed for the magnetic roll is 317 mm/second and the high speed is 1268 mm/second, although other speeds may be selected. Preferably, the low speed, which is selected in response to the reload defect not being likely, is approximately 25% of the high speed that is used to attenuate or prevent reload defect.

When the magnetic roll of a development system is operated at a low speed that is approximately 25% of the high speed used to counteract reload defect, the operational life of the development system before corrective action is required is extended considerably. A magnetic roll speed selector 98 that generates a digital value may generate a value that corresponds to a magnetic roll speed in a predetermined range of magnetic roll speed. In this embodiment, the speed signal may be used to adjust the speed of the magnetic roll in a way that accounts for the size of the reload defect, the spatial frequency of the area in which the reload defect may occur, or the like. That is, the speed of the magnetic roll may be controlled to be sufficient to address the reload defect that is determined likely to occur and not the worst case scenario anticipated by the high magnetic roll speed. This worst case scenario is sometimes described as a solid area followed by a midlevel halftone separated from the original solid area by the equivalent of one donor roll revolution.

The magnetic roll speed selector 98 may also include an input for a development voltage, a comparator for comparing the development voltage and a reference signal, and the magnetic roll speed selector 98 generates a continuous high speed signal in response to the development voltage being equal to or greater than the reference signal. The reference signal corresponds to the maximum development voltage for the development system. Thus, when the development voltage is equal to or exceeds the maximum development voltage, the magnetic roll is continuously driven at the high speed used to counteract reload defect.

Figure 3:
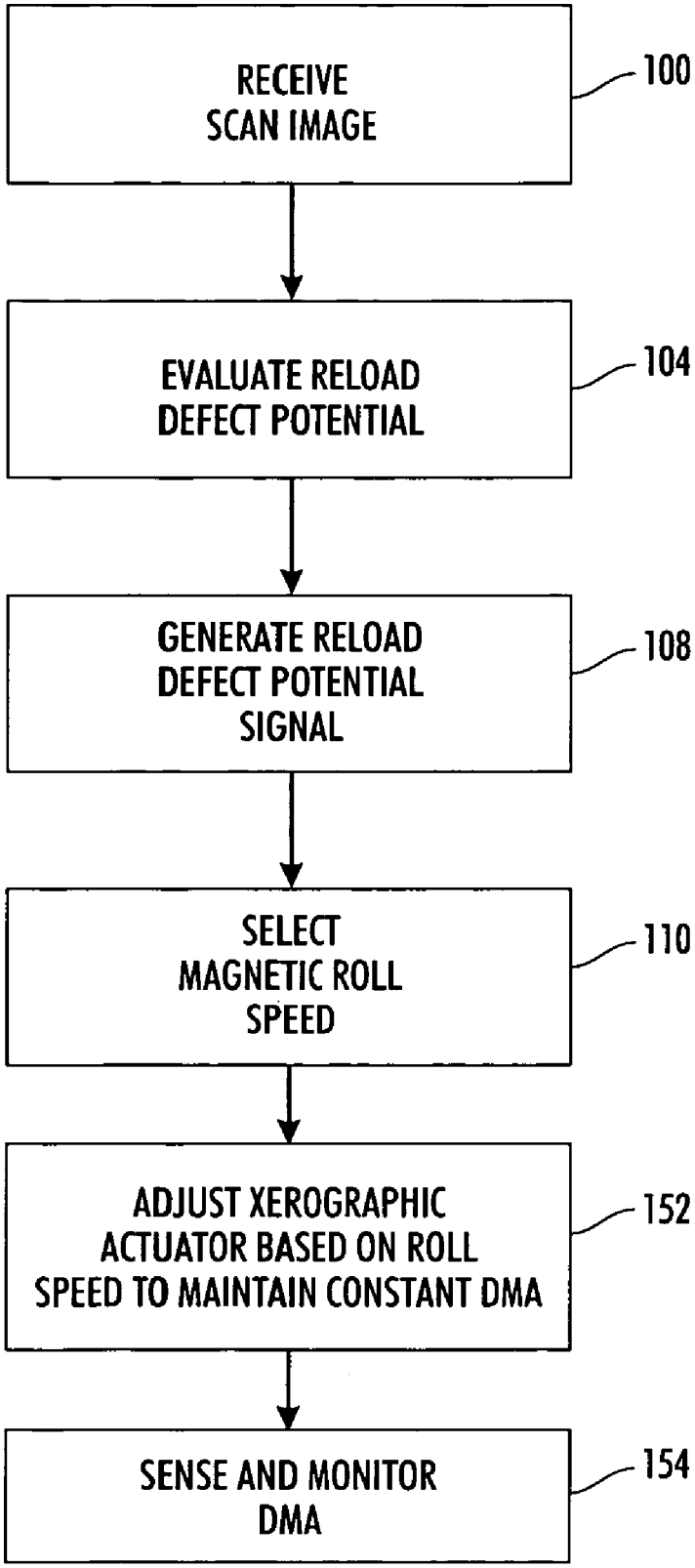
FIG. 3 is a flow diagram of method for operating a development system in a manner that reduces reload and maintains constant DMA.

An improved method for operating a development system in an electrophotographic system is shown in FIG. 3. The method includes receiving an scan image (block 100), evaluating the likelihood of a reload defect occurring in the development of the image (block 104), generating a signal corresponding to a potential for reload defect detected in the scan image (block 108), and selecting a rotational speed for a magnetic roll in a development system of the electrophotographic system (block 110). The selected rotational speed corresponds to the reload defect potential signal.

The method may select a rotational speed by generating a signal indicative of a reload defect potential in the image to be developed. The generated potential reload defect signal may be an analog signal, the peak to peak voltage or frequency of which may be used to drive the magnetic roll speed. The method may alternatively select a magnetic roll speed by generating a digital signal. The digital signal may be a binary signal or a digital value. Each state of the binary signal corresponds to a predetermined speed for the magnetic roll. A digital value may be used to select a magnetic roll speed from a range of predetermined speeds for the magnetic roll.

In operation, a DFE of an electrophotographic system may be modified to include a reload defect detector that generates a signal indicative of the potential for reload defect during the development of an image. The DFE or the development system controller may be modified to include a magnetic roll speed selector. The electrophotographic system may use one or more donor rolls. The system that adjusts magnetic roll speed to reduce toner abuse may be used in a hybrid scavengeless development system or a direct magnetic brush development system. As the electrophotographic system is operated, the reload defect detector determines the potential reload defect in an image to be produced by the system. If the potential indicates a reload defect is likely during the development of the image, the magnetic roll speed that best counteracts reload defect is selected. If the potential indicates a defect is not likely, a slower magnetic roll speed is selected to preserve the life of the toner. If the magnetic roll speed selector receives a signal corresponding to a development voltage, the speed selection process continues until the development voltage receives its maximum. Then, the magnetic roll is continuously operated at the speed that best counteracts reload defect until corrective action takes place. The structure thus far describe is substantially that illustrated and described in the previous cited U.S. application Ser. No. 11/090,727, now U.S. Publication No. 20060216049, entitled "METHOD AND SYSTEM FOR REDUCING TONER ABUSE IN DEVELOPMENT SYSTEMS OF ELECTROPHOTOGRAPHIC SYSTEMS."

Figure 4:
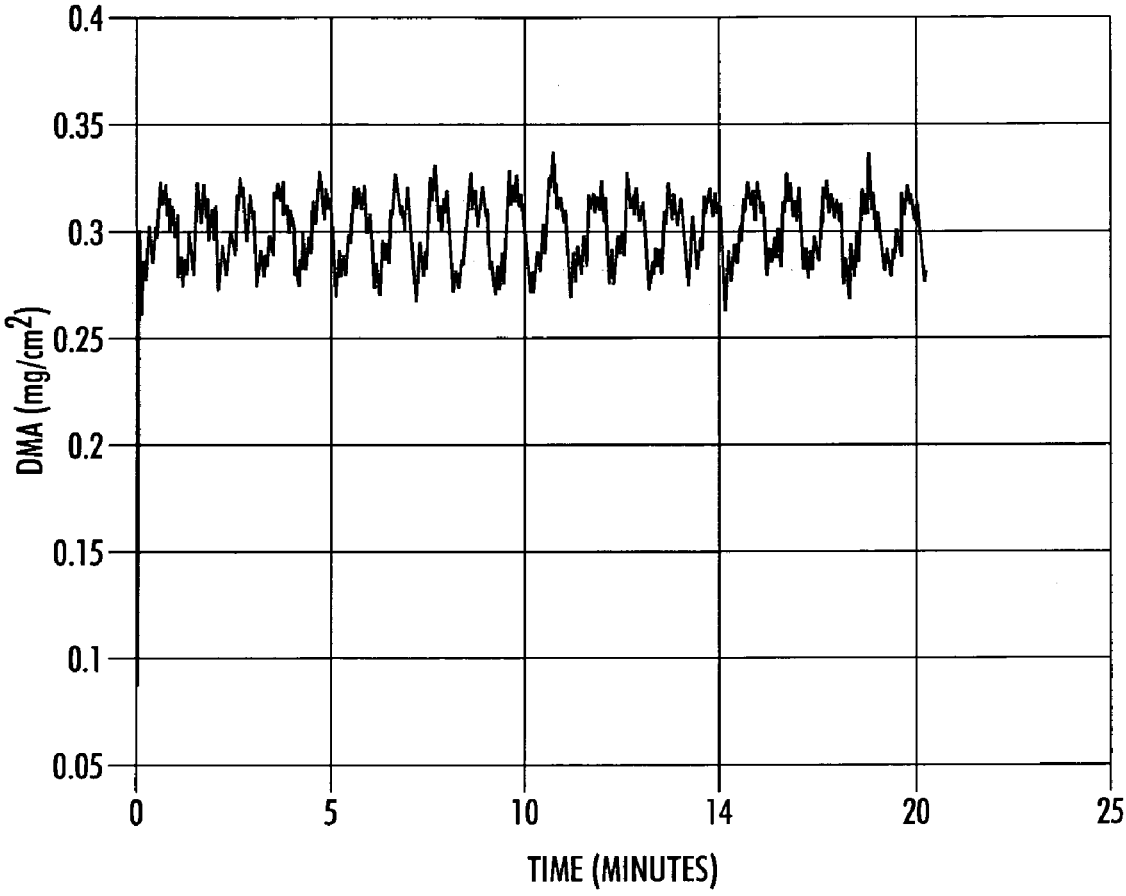
FIG. 4 illustrates experimental data of DMA transients with changes in magnetic roll speed with standard closed-loop PID process controls.

Now focusing on aspects of the present disclosure. As discussed supra reducing the speed of the magnetic roll in an HSD developer housing based on image content information can provide a mechanism to reduce material abuse during low area coverage (LAC) print jobs and overcomes the potential reload problems to enable slowing the magnetic roll during non-stress pages of a customer's job. It has also been found by the Applicants experimentally that substantial shifts in developed mass occur when the speed of the roll is changed as illustrated in experimental data shown in FIG. 4. In FIG. 4, the DMA results are present for an experiment where the development system was operated with the standard PID process controls and the speed of the magnetic roll was toggled between two levels. It is clear from the data presented in this figure that significant shifts in the output DMA are created when the speed of the magnetic roll is varied, despite the presence of a standard PID feedback controller whose purpose is to maintain consistent output developed mass. Applicants' present disclosure provides a control approach to counter these rapid shifts in developed mass in order to maintain consistent output mass regardless of the speed profile of the magnetic roll.

Focusing on aspects of the present disclosure that details the use of feed forward controllers to address the problem of undesirable DMA shifts caused by changes in the speed of the magnetic roll in an HSD housing. The input digital image is received (block 100) and analyzed to determine the potential for the occurrence of reload defects (block 104). This information is then used to generate a reload defect potential signal (block 108). A desired speed profile for the magnetic roll is then computed (block 110) and applied to the magnetic roll motor. [Applicants have generated a predictive model of the output DMA response to changes in the speed of the magnetic roll which is used to anticipate impending DMA transients.] This information is then used to calculate an adjustment to the development actuators in order to cancel the impending developed mass shift before it occurs as the magnetic roll's speed is varied (block 152). The output DMA is monitored (block 154) and appropriate adjustments are made to the feed-forward controller parameters in an adaptive fashion. This adaptive update process ensures that the controller will maintain the desired output performance despite variations in the development parameters over time. Applicants have found that this adaptive controller is capable of mitigating the undesirable developed mass shifts such that the solid area DMA can be maintained at a constant level, regardless of the speed profile used to drive the magnetic roll. This outcome is desirable since it enables changing the speed of the magnetic roll during the printing of the customer job, which can help to reduce the abuse of the developer material, without inducing unwanted defects in the output prints.

Applicants have found that standard feedback process controls used to maintain consistent developed mass is insufficient to counter the DMA transients caused by changing the speed of the magnetic roll. The present disclosure uses a feed-forward control loop to augment the standard feedback process controls. In general, feed-forward controllers are typically more capable of responding to very rapid transients caused by system disturbances than are feedback controllers. The feedforward controller is designed to anticipate impending changes to the output being controlled based on known information about the system. This anticipated change is then countered through appropriate adjustments to system actuators such as developer bias, toner dispense, ROS exposure power, and charging bias. In this way, the feed forward controller is able to begin counteracting the impending drift in the system, potentially before it actually starts occurring.

Figure 5:
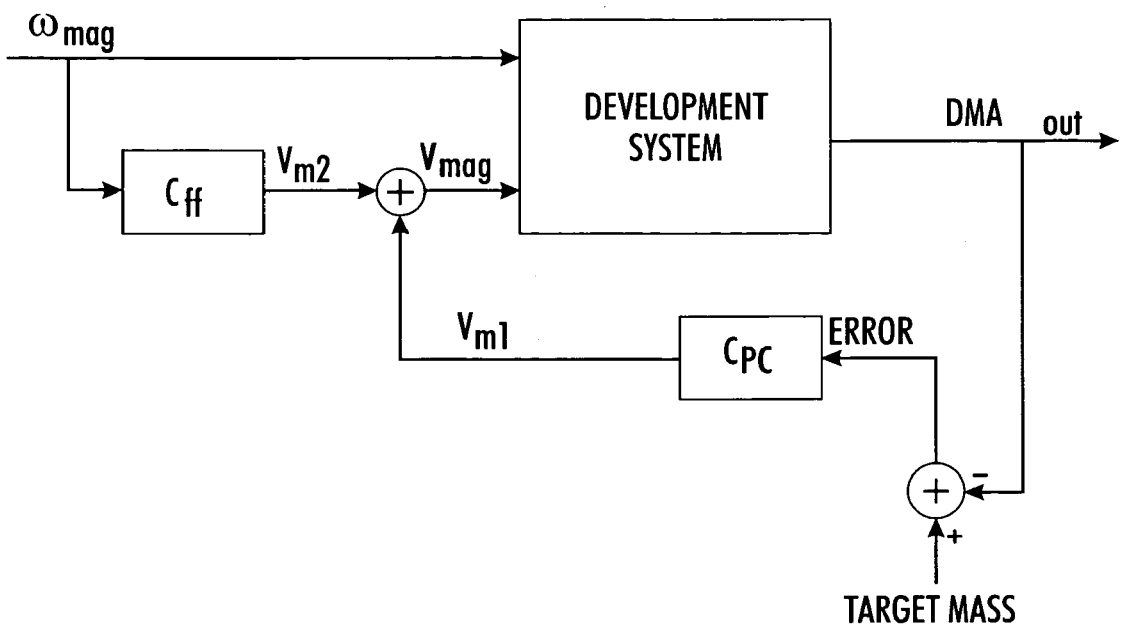
FIG. 5 illustrates a block diagram of a control architecture for enabling consistent output DMA despite changes to the speed of the magnetic roll during the printing of the customer job.

FIG. 5 illustrates a block diagram of the proposed control architecture for enabling consistent output DMA despite changes to the speed of the magnetic brush roll during the printing of the customer job.

In this diagram, $C_{pc}$ refers to the standard feedback process controls while $C_{ff}$ refers to the proposed feed forward controller. From this diagram, it is seen that the speed profile for the magnetic brush roll is used to generate a second control actuator signal $V_{m2}$. This feed forward path utilizes knowledge of the development system to anticipate what the output DMA response will be to changes in the speed of the magnetic brush roll. With this information, the feed forward controller can then generate an input to the xerographic actuators that will counteract the impending DMA shifts as the speed of the magnetic brush roll is varied.

Figure 6:
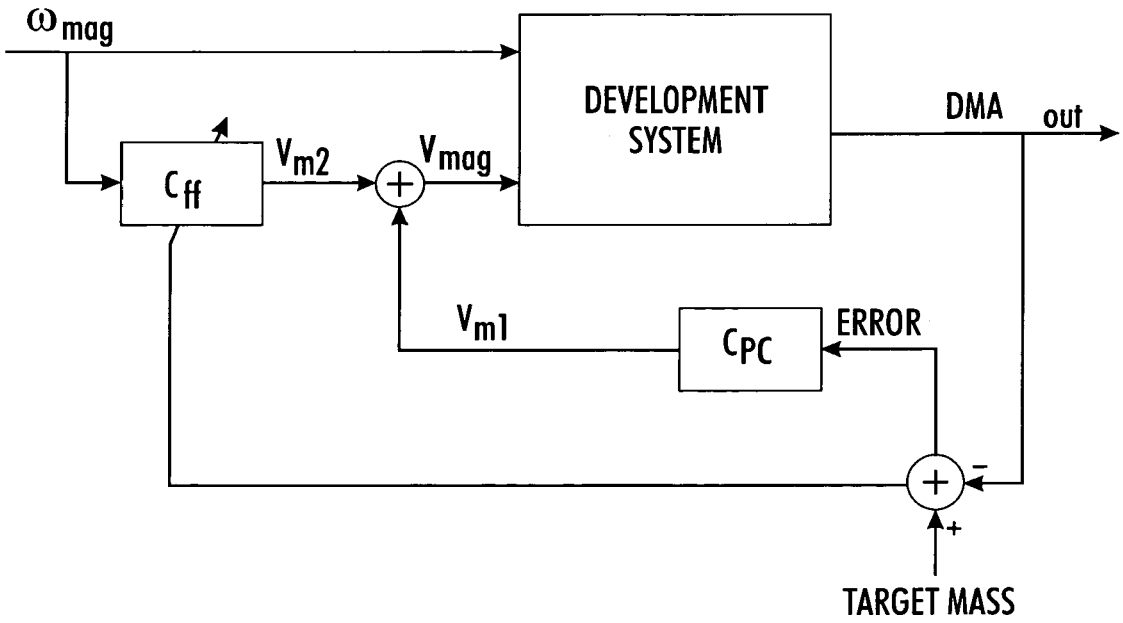
FIG. 6 illustrates block diagram of another embodiment of a control architecture for enabling consistent output DMA despite changes to the speed of the magnetic roll during the printing of the customer job.

In another embodiment as illustrated in FIG. 6, the feed forward controller is an "adaptive" controller. In other words, the parameters of the controller are automatically adjusted by an update algorithm while the controller is operating on the system. This adaptive update process is designed such that these parameter adjustments are made in an effort to improve system performance based on the following information:

How the output of the development system responds to changes in the speed of the magnetic roll (the forward path from $\omega_{mag}$ to $DMA_{out}$); and how the output DMA responds to the development actuator $V_{dev}$.

Applicants have found that standard feed forward control schemes are not very robust to variations in the process parameters (for instance changes in the development slope $\gamma$). When printing LAC documents, the development parameters will typically change with time (as material abuse and development loss occur, the required actuator voltage input to achieve target developed mass changes). Other slow drifts in the development process parameters can be expected to occur as well.

A variety of techniques can be used to make the feed forward controller more robust to such disturbances. One particular example of such a technique is the use of an adaptive update process based on feedback from the output performance (the actual developed mass) to adjust the feed forward controller parameters.

In this architecture, the parameters of the feed forward controller are adjusted based on the performance of the system (as measured by the error in the output tracking). There are many methods by which this sort of adaptive update may be implemented. The following outlines one example of such an implementation for this type of scheme.

In this sample implementation, the following simple model for the development system was used:

$$DMA(t)=DMA_0(t)+DMA_{speed}(t) \tag{1}$$

where $DMA_0(t)$ represents the component of the output DMA with the magnetic roll running at full speed (the standard development model) and the $DMA_{speed}(t)$ term represents the dynamics of the output response due to the changing of the speed of the magnetic roll. Assuming a simple linear approximation to the standard development model gives the following:

$$DMA(V_{mag})+\gamma_{local}\,V_{mag}+D_0 \tag{2}$$

where $\gamma_{local}$ represents the local development slope and $D_0$ represents the y-intercept of the linear approximation to the development curve. Using this linear approximation and referring to FIG. 6, the output DMA response can be written as follows $$DMA(t)=\gamma_{local}[V_{m1}(t)+V_{m2}(t)]+D_0 \tag{3}$$

The following feed forward controller form was then introduced:

$$V_{m2}(t)=K_{ff}(t)DMA_{speed}(t) \tag{4}$$

In this equation, $V_{m2}(t)$ is the controller output from the feed forward controller, the term $DMA_{speed}(t)$ represents the dynamics of the development system response to changes in the speed of the magnetic brush roll, and $K_{ff}(t)$ represents the feed forward controller gain. If the development system parameters were exactly known, the desired value for the feed forward controller gain would then be:

$$K^*_{ff}=-1/\gamma_{local} \tag{5}$$

This would serve to cancel the contribution $DMA_{speed}(t)$ to the output DMA (see (1) and (3)), thereby eliminating the output DMA's dependence on the velocity profile of the magnetic roll. Since it is incredibly difficult to know the development parameters to such an exact level as required by (5), and because the process parameters are expected to change over time, an adaptive update was used to determine the feed forward gain. To this end, the following adaptive update was designed and implemented to adjust the feed forward gain ($K_{ff}$):

$$\frac{d}{dt}K_{ff}(t)=-\mu e(t)DMA_{speed}(t) \tag{6}$$

In this equation, e(t) represents the output developed mass error (the difference between the desired DMA target and the current output DMA) and $\mu$ represents a positive convergence parameter that can be chosen as part of the design. Note that many design techniques could be employed to achieve other adaptive update equations. The key is that the adaptive process is being used as a mechanism to maintain an appropriate feed forward controller gain in spite of plant variations during normal operation of the development system.

Figure 7A:
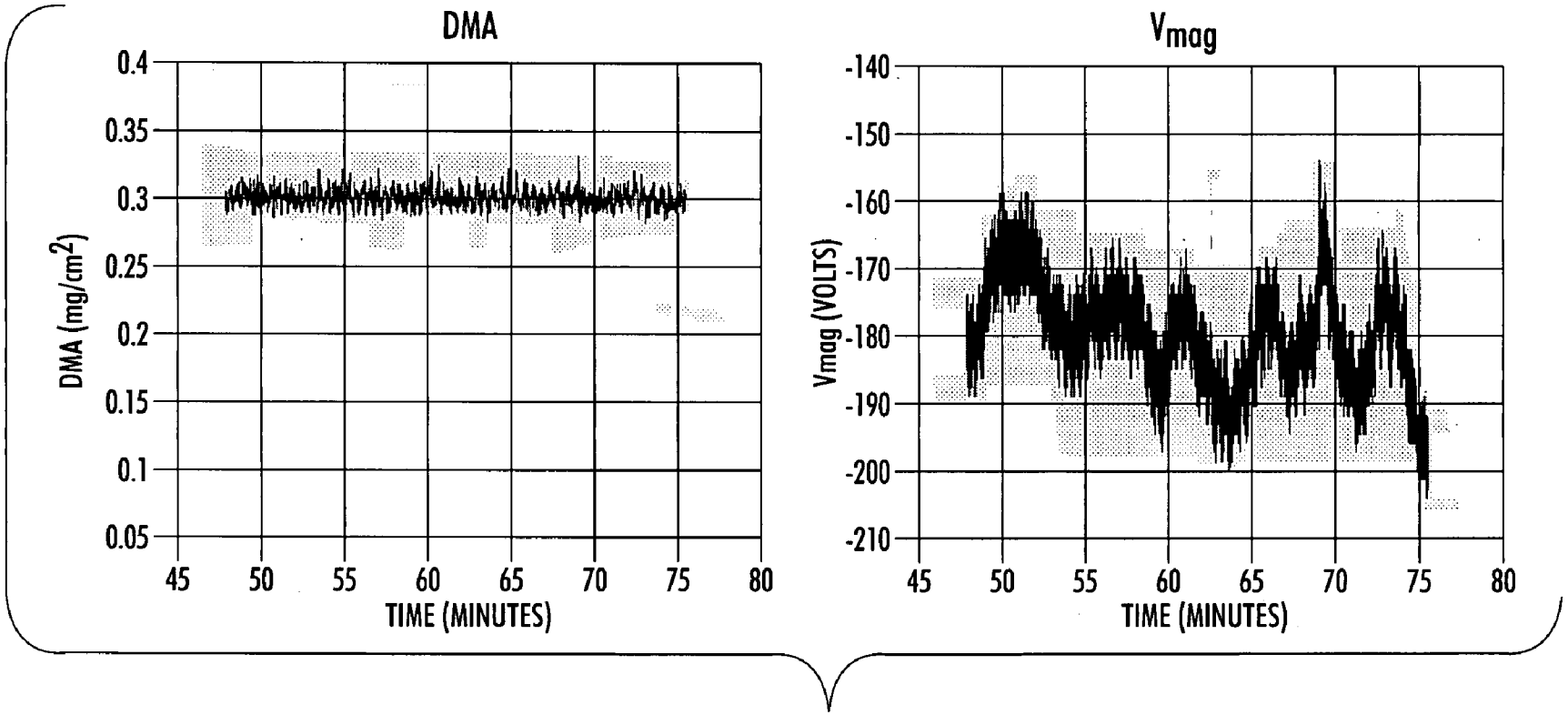
FIGS. 7*a*-7*c* illustrates experimental graphs of DMA transients with changes in magnetic roll speed in conjunction with corresponding graphs of adjustments made to xerographic actuators.
Figure 7B:
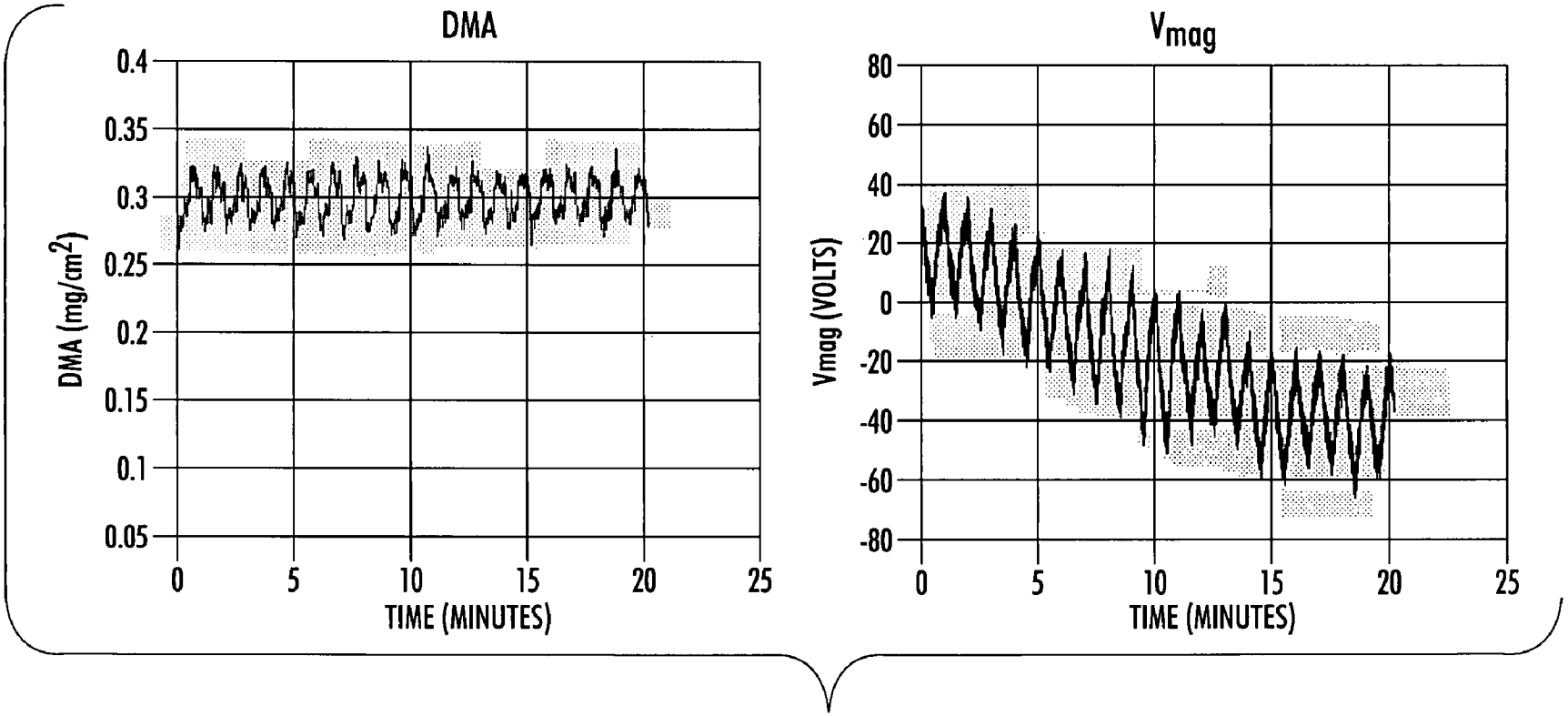
Figure 7C:
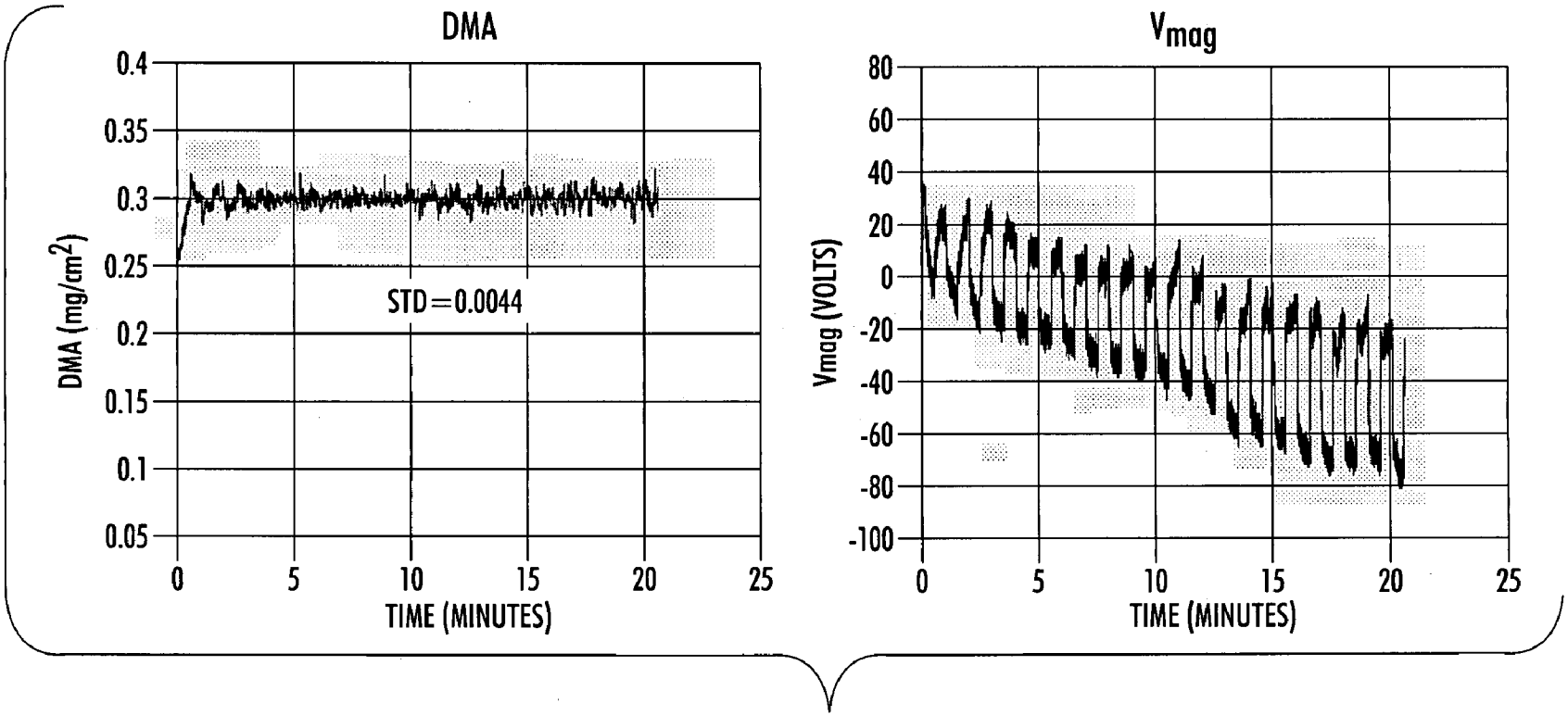

An example of the experimental results obtained using the proposed feed forward architecture and the specific adaptive update algorithm in Equation (6) is shown in FIGS. 7*a*-7*c*. The data presented in FIG. 7*a* was taken with the speed of the magnetic roll constant (the roll ran at full speed throughout the test). This data is used as a reference point to compare the DMA noise level of the standard operating mode with that for the case of toggling the speed of the magnetic roll and using the specified adaptive feed forward controller. In generating the data presented in FIGS. 7*b* and 7*c*, the speed of the magnetic roll was toggled between full-speed and quarter-speed every 30 seconds. For the data in FIG. 7*b*, the standard PID process controller was implemented. It is clear from this figure that the controller was unable to prevent significant fluctuations in the output DMA as the speed of the magnetic roll was varied. FIG. 7*c* illustrates the results for the adaptive feed forward controller with the speed of the magnetic roll again being toggled between two speeds every 30 seconds. Note that in this case the initial DMA transients from the roll speed changes are quickly damped out as the adaptive update process adjusts the feed forward controller gain $K_{ff}$. In fact, after the first five minutes of the experiment, the typical square wave response in the output DMA is no longer visible even though the speed of the magnetic roll is still being varied.

It is illustrative to compare the noise level of the output DMA after the first five minutes of this experiment (FIG. 7*c*) with that for the standard process controls with a constant magnetic roll speed (see FIG. 7*a*). From this comparison it is seen that the adaptive feedforward controller is capable of maintaining the output DMA to within a similar tolerance as the standard process controller with a constant speed magnetic roll. In other words, the controller of the present invention is able to maintain consistent DMA output despite significant changes in the speed of the magnetic roll. This is a significant improvement over the standard development process control techniques.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A development system for an electrophotographic system comprising:

a magnetic roll speed selector for selecting a rotational speed for a magnetic brush roll in a development system of the electrophotographic system; and a controller, responsive to said rotational speed, for adjusting xerographic actuators to maintain DMA within a predefined range, said controller includes a feed forward controller.

2. The development system of claim 1, wherein said xerographic actuator is selected from at least one of xerographic actuator selected from the group consisting of developer bias, toner dispense, ROS exposure power, and charging bias.

3. The development system of claim 1, wherein said feed forward controller includes means for anticipating impending DMA transients based on a model of the system; and means for determining adjustment values for the xerographic actuators to counteract the anticipated developed mass shift before it occurs.

4. The development system of claim 3, wherein said determining means includes feedback process controls to generate a first control signal and feedforward control based on a speed profile for the magnetic roll to generate a second control signal.

5. The development system of claim 1, wherein said feed forward controller includes an adaptive model for anticipating and counteracting impending DMA transients.

6. The development system of claim 5, wherein said model is an adaptive model which is characterized by following equation $$V_{m2}(t)=K_{kk}(t)DMA_{speed}(t)$$

where, $V_{m2}(t)$ is the controller output from the feed forward controller, the term $DMA_{speed}(t)$ represents the dynamics of the development system response to changes in the speed of the magnetic roll, and $K_{ff}(t)$ represents the feed forward controller gain.

7. A development system for an electrophotographic system comprising:

a magnetic roll speed selector for selecting a rotational speed for a magnetic brush roll in a development system of the electrophotographic system;

a controller, responsive to said rotational speed, for adjusting xerographic actuators to maintain DMA within a predefined range; and a reload defect detector for generating a signal corresponding to a potential for reload defect detected in a scanned image to be developed by an electrophotographic system, and wherein said magnetic brush roll speed selector being coupled to the reload defect detector to receive the signal generated by the reload defect detector and selecting a rotational speed for the magnetic brush roll in response to the generated reload defect potential signal.

8. The development system of claim 7, the reload defect detector further comprising:

a reload defect evaluator for comparing a source area to a destination area in the scanned image to determine the potential for a reload defect during the development of the scanned image.

9. The development system of claim 7, further comprising:

a motor drive for a magnetic brush roll in the electrophotographic machine; and a magnetic brush roll coupled to the motor drive, the magnetic brush roll speed selector being coupled to the motor drive so that the signal generated by the magnetic brush roll speed selector determines the speed of the magnetic brush roll in response to the signal received from the reload defect detector.

10. The development system of claim 7, the reload defect detector generating a digital signal having a value that is indicative of a probability for the detected reload defect.

11. A method for operating a development system for an electrophotographic system comprising:

selecting a rotational speed for a magnetic brush roll in a devetopment system of the electrophotographics system; and adjusting xerographic actuators, responsive to said rotational speed, to maintain DMA within a predefined range, said adjusting includes employing a feed forward controller.

12. The method of claim 11, wherein said adjusting includes selecting from at least one of xerographic actuator selected from the group consisting of developer bias, toner dispense, ROS exposure power, and charging bias.

13. The method of claim 11, wherein adjusting includes anticipating impending DMA transients based on a model of the system; and determining adjustment values for the xerographic actuators to counteract the anticipated developed mass shift before it occurs.

14. The method of claim 13, wherein said model is an adaptive model which is characterized by following equation $$V_{m2}(t)=K_{ff}(t)DMA_{speed}(t)$$

where, $V_{m2}(t)$ is the controller output from the feed forward controller, the term $DMA_{speed}(t)$ represents the dynamics of the development system response to changes in the speed of the magnetic roll, and $K_{ff}(t)$ represents the feed forward controller gain.

15. An electrophotographic printer, comprising:

a development system having a magnetic roll speed selector for selecting a rotational speed for a magnetic brush; and a controller, responsive to said rotational speed, for adjusting xerographic actuators to maintain DMA within a predefined range, said controller includes feed forward controller includes means for anticipating impending DMA transients based on a model of the system; and means for determining adjustment values for the xerographic actuators to counteract the anticipated developed mass shift before it occurs.

16. The printer of claim 15, wherein said xerographic actuator is selected from at least one of xerographic actuator selected from the group consisting of developer bias, toner dispense, ROS exposure power, and charging bias.

* * * * *